United States Patent [19]

Leroux

[11] 3,987,560

[45] Oct. 26, 1976

[54] DEVICE FOR ASSEMBLING A BUCKET ON A FRAME

[75] Inventor: Jean E. Leroux, Lagny-le-Sec, France

[73] Assignee: Societe Anonyme: Poclain, Le Plessis-Belleville, France

[22] Filed: July 14, 1975

[21] Appl. No.: 595,436

[30] Foreign Application Priority Data

July 22, 1974 France ..... 74.25378

[52] U.S. Cl. ..... 37/4; 214/131 R; 214/78

[51] Int. Cl.[2] ..... E02F 5/00

[58] Field of Search ..... 37/4, 117.5; 214/78, 214/500, 501, 508, 131 R, 140, 778

[56] References Cited

UNITED STATES PATENTS

| | | | |
|---|---|---|---|
| 631,096 | 8/1899 | Smith | 37/4 X |
| 1,773,496 | 8/1930 | Osman | 37/4 |
| 1,926,309 | 9/1933 | Pierce | 37/4 |
| 2,462,432 | 2/1949 | Scribner | 37/4 |
| 2,468,220 | 4/1949 | McLendon | 37/4 X |
| 3,406,848 | 10/1968 | Zink | 214/78 |

FOREIGN PATENTS OR APPLICATIONS

| | | | |
|---|---|---|---|
| 510,007 | 1/1955 | Italy | 214/78 |
| 551,721 | 3/1943 | United Kingdom | 214/78 |

*Primary Examiner*—E. H. Eickholt
*Attorney, Agent, or Firm*—Mason, Fenwick & Lawrence

[57] ABSTRACT

This invention relates to a device for assembling a bucket on a frame comprising, in addition to said bucket, a zone of articulation of this bucket at a determined spot on the frame, disposed so that the resultant configuration enables the material to be loaded into the bucket and another zone of articulation of the bucket at another spot on the frame, disposed so that the other resultant configuration enables the material contained in the bucket to be unloaded. The changes in configuration are made by pins controlled by jacks and introduced selectively into orifices, the controls of the jacks being synchronized so as to permanently provoke the insertion of certain of the pins into the orifices of at least one of said two zones. One application of the present invention is the production of a loader bucket.

10 Claims, 6 Drawing Figures

DEVICE FOR ASSEMBLING A BUCKET ON A FRAME

The present invention relates to a system for mounting a bucket on a frame, particularly of a loader.

To manufacture a machine for loading any type of material, said machine is often provided with a bucket articulated to the end of an arm articulated to the frame of the machine, and preferably connected to the frame by means of two arms articulated to each other.

When it is desired to simplify the construction of the machine, it is sought to eliminate the arms connecting the bucket to the frame and to assemble said bucket directly on the frame. However, due to the imperfect character of such an assembly, a satisfactory loading and unloading of the bucket has hitherto not been obtained.

The invention intends to remedy this state of affairs by proposing a particular assembly of a bucket on a frame which, whilst being simple and efficient, functions safety both at the moment of loading and unloading.

To this end, the invention therefore has for its object a device for assembling a bucket on a frame, comprising, in addition to said bucket, a zone of articulation of this bucket at a determined spot on the frame, disposed so that the resultant configuration enables the material to be loaded into the bucket and another zone of articulation of said bucket at another spot on the frame, disposed so that the other resultant configuration enables the material contained in the bucket to be unloaded, the bucket comprising a position in which may be effected the change of articulation of one to the other of said zones and from one to the other of spots, and vice versa, said first zone then being disposed opposite said first spot, whilst the other zone is itself disposed opposite the other spot and articulation pins being fast with the mobile members of jacks, which are disposed at one and the other spot on the frame, said pins being capable of being inserted in pin socket openings made in one and the other zone of articulation of the bucket.

In this device, the controls of the jacks are synchronized so as to always maintain at least two of said pins inserted in their pin socket openings at all times.

The invention will be more readily understood on reading the following description with reference to the accompanying drawings, in which.

Figure 3:
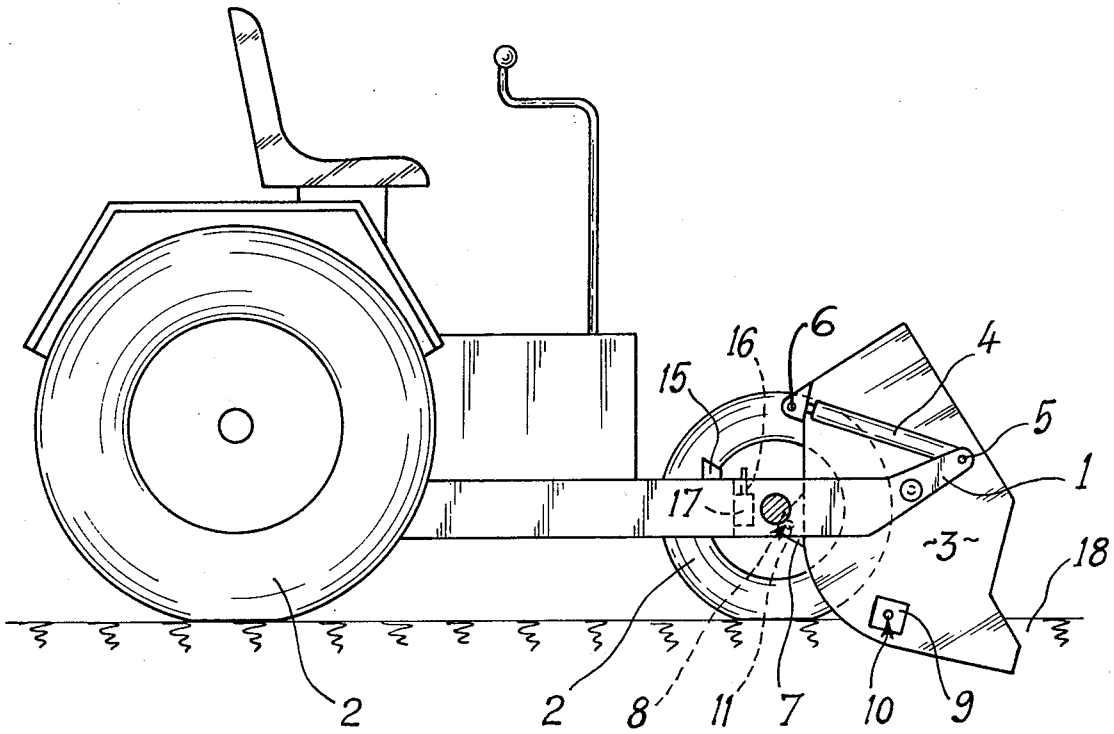
FIG. 3 and 4 are elevations similar to that of FIG. 1, of the same machine, but in two other distinct configurations.

Bucket 13 is provided with rearward tabs 6 fixedly connected to the bucket and each having a rearward pin socket opening 8 and with forward tabs 9 also fixedly connected to the bucket and each having a forward pin socket opening 10. Axially movable rearward bucket support pins 11 can be positioned in the rearward pin socket opening 8 to provide pivotal support of the bucket member 3 for movement about a first pivot axis coextensive with the axis of pins 11. Forward bucket support pins 12 are also selectively engageable between the bucket and the pin socket openings 10 for also providing selective pivotal support of the bucket member about a second axis coextensive with the axis of pins 12 for a purpose to be discussed hereinafter. Additionally, bucket tilt jacks 4 (FIG. 4) are connected to the frame 1 by pin means 5 and to a rear portion of the bucket by pin means 6. When the bucket is in its generally horizontal load carrying position of FIG. 1, it engages an abutment stop 15 on the frame 1 and also engages a valve actuator rod for controlling a two-way distributor valve 17. Pins 11 are aligned with pin socketing opening 8 and pins 12 are aligned with pin socket openings 10 when the bucket is in the position of FIG. 1. FIG. 3 illustrates bucket 3 pivoted to an excavating loading position about the axis of pins 11 which are positioned in pin socket openings 8. The bucket is supported for pivotal movement about the axis of pins 11 with the bucket being moved to the illustrated excavating or loading position by contraction of the jack members 4 to the positions illustrated in FIG. 3. It will be noted that the pin socket openings 10 and pins 12 are not engaged during movement of the bucket from its FIG. 1 position to its FIG. 3 position so that the bucket is free to pivot about pivot pins 11. In this position of the components, the bucket 3 is usable as a loader bucket or to dig into the ground 18 and to load excavated material.

Figure 4:
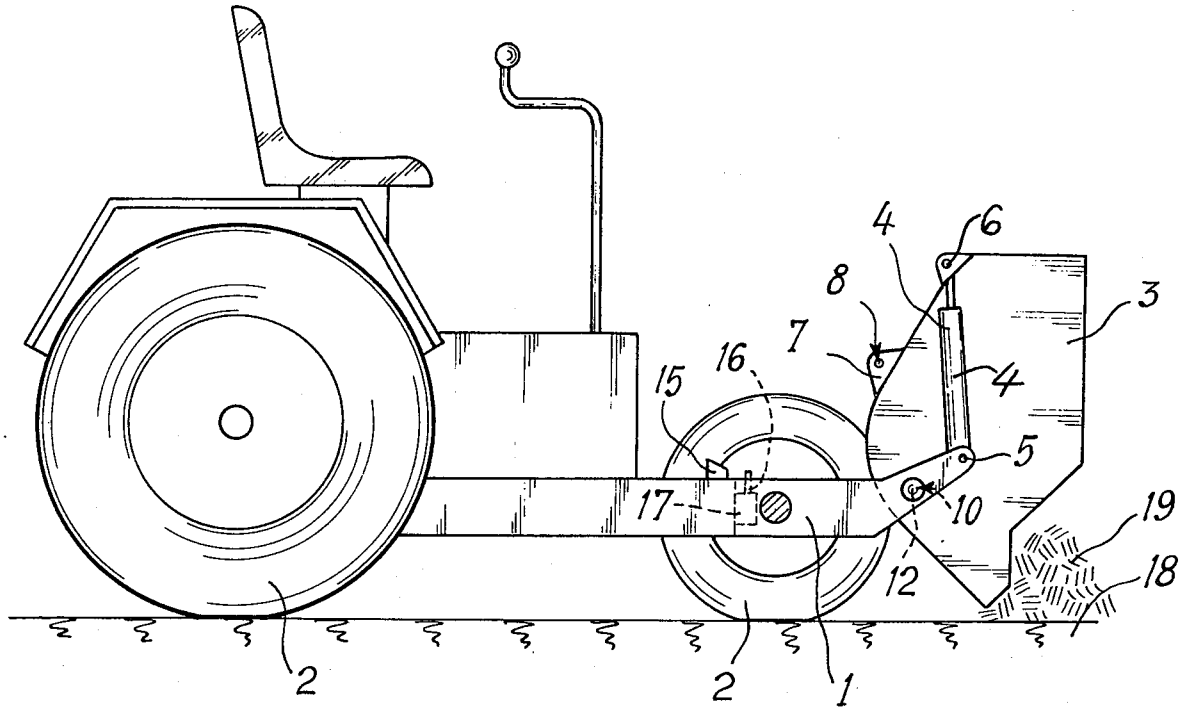

FIG. 4 illustrates a different mounting configuration of the bucket in which the bucket is pivotally supported for movement about the axis of forward pivot pin members 12 which are inserted in the forward pin socket openings 10 with rearmost pins 11 being retracted from rearmost pin socket openings 8 to permit pivotal movement of the bucket. Actuation of the jack 4 pivots the bucket to the illustrated position from the FIG. 1 position so that material carried in the bucket flows from the bucket onto the surface of the ground 18 to form a pile 19.

Figure 5:
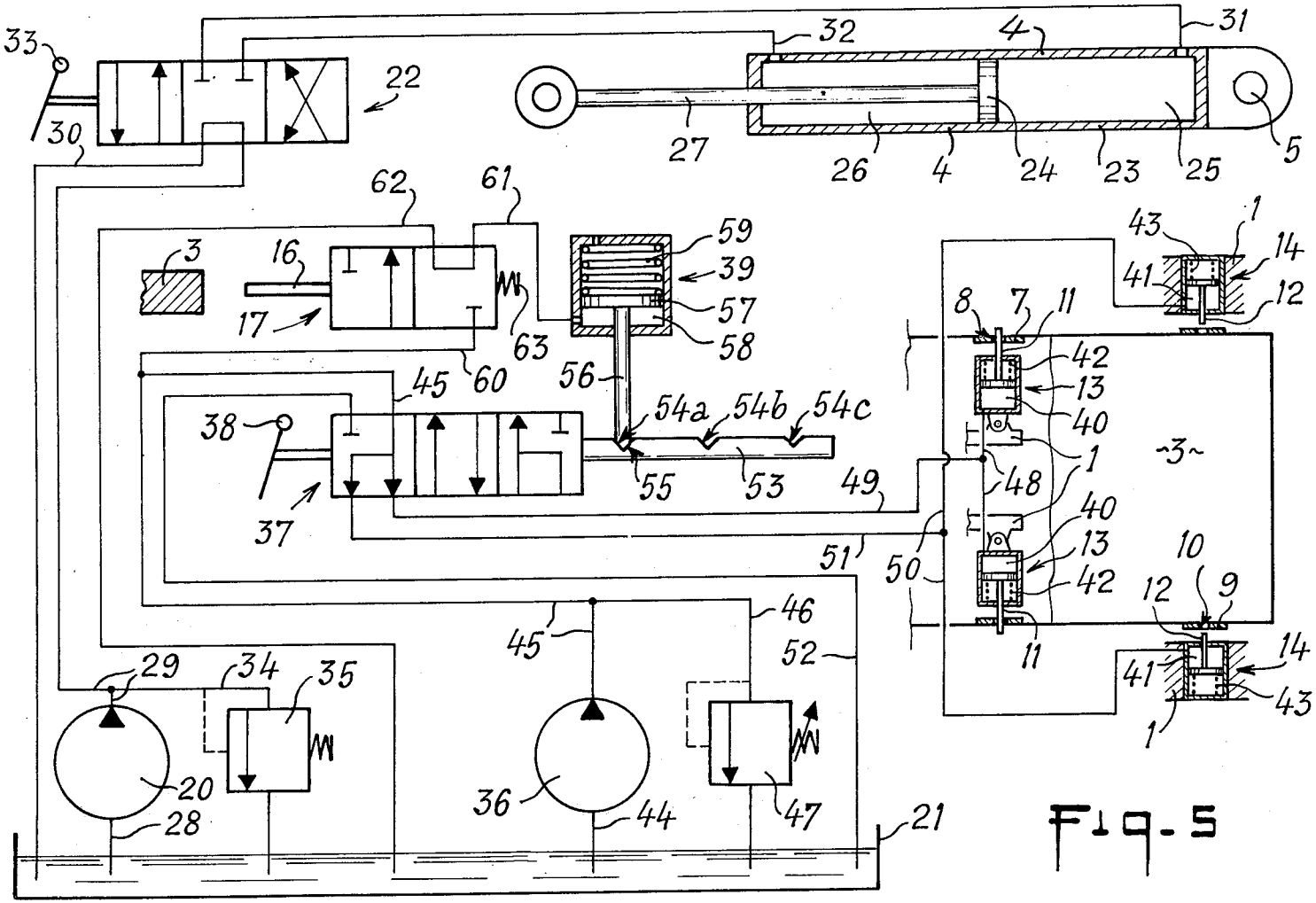
FIG. 5 shows the diagram of a hydraulic device for controlling the bucket of the machine shown in FIGS. 1 to 4.

FIG. 5 shows the diagram of the hydraulic circuit for controlling the position of the bucket, when said latter is disposed in the configuration of FIG. 3.

This circuit is constituted by two sub-assemblies: the one corresponding to the conventional control of the jack 4 and the other for operating jacks 13 and 14 to effect a desired articulation.

The device for controlling the jack 4 comprises:

a pump 20, a fluid reservoir 21, a three-way distributor 22, and the jack 4, constituted by a cylinder 23, a piston 24, which defines in the cylinder 24 two chamber 25 a conduit 32, whilst a control lever 33 is coupled thereto. A discharge conduit 34 is tapped to conduit 29, whilst a calibrated discharge valve 35 is disposed in said conduit 34.

The three positions of the distributor 22 correspond as follows:

the first position corresponds to the communicating of conduits 30 and 31 and of conduits 29 and 32;

the second position to the communicating of conduits 29 and 30, and to the closure of conduits 31 and 32 by the distributor 22;

and the third position, to the communicating of conduits 30 and 32, and of conduits 29 and 31.

The device for operating and controlling the jacks 13 and 14 comprises:

a pump 36 a three-way distributor 37 provided with a control lever 38, a jack 39 for selectively locking the position of the distributor 37, the distributor 17, and the jacks 13, 14 which are coupled to the frame 1, each of which comprises a driving chamber 40, 41 and a return spring 42, 43 for their piston and pin 11, 12 fast with the piston of said jacks, respectively.

Return spring 42 of the jack 13 works in opposition to the force created by hydraulic pressure in the driving chamber 40 so as to tend to maintain the pin 11 retracted from the pin socket opening 8. However, return spring 43 of the jack 14 exerts a force opposite the force created by hydraulic fluid in driving chamber 41 which spring force tends to urge the pin 12 into the pin socket opening 10 and to maintain the pin therein in an obvious manner.

The pump 36 is connected to the reservoir 21 by its suction conduit 44 and to the distributor 37 by its delivery conduit 45. A discharge conduit 46 is tapped to the conduit 45 which it connects to the reservoir 21, a calibrated discharge valve 47 being disposed in this conduit 46.

The driving chambers 40 of the jacks 13 being connected by a conduit 48, a conduit 49 connects the distributor 37 to said conduit 48. Similarly, the driving chambers 41 of the jacks 14 being connected by a conduit 50, a conduit 51 connects the distributor 37 to said conduit 51.

Finally, a conduit 52 connects the distributor 37 to the tank 21.

The three positions of the distributor 37 correspond, furthermore, as follows:

the first position, to tthe communication of conduits 45, 49 and 51, and to the closure by distributor 37 of conduit 52;

the second position, to the communicating of conduits 45 and 49, and of conduits 51 and 52;

and the third position to the communicating of conduits 49, 51 and 52, and to the closure by distributor 37 of conduit 45.

An element 53, provided with notches **54*a*, 54*b* and 54*c*, is fast with the mobile member of the distributor 37. The notches 54*a*, 54*b* and 54*c*, corespond respectively to the first, second and third positions of the distributor 37, and, when the distributor 37 is placed in said position, are themselves disposed opposite the end 55 of a rod 56 fast with the piston 57 of the jack 39**.

It is to be noted that the jack 39 comprises a driving chamber 58 and a spring 59, of which the effect on piston 57 opposite to that of the fluid contained in the driving chamber 58 and which tends to cause the end 55 to be introduced into one of said notches of the element 53.

The distributor 17 is connected by a conduit 60 to the conduit 45, by conduit 61 to the driving chamber 58 and by a conduit 62 to the reservoir 21. Its two positions correspond as follows:

the first position, to the communicating of conduits 60 and 61 and to the obturation by distributor 17 of conduit 62;

and the second position to the communicating of conduits 61 and 62, and to the closure by distributor 17 of conduit 60.

It is to be noted that spring 63 is coupled to the mobile member of the distributor 17 and has an effect which tends to place this distributor in its second position and is opposite the action of the abutment on the bucket 3 engageable with rod 16 so that sprig 63 tends to maintain the distributor in the condition illustrated in FIG. 5 when the bucket 3 is not engaged with the rod 16.

Consequently, the bucket can be supported for pivotal movement about the axis of the pins 11 or alternatively about the axis of the pins 12 with the position of the bucket being tiltably adjusted by operation of the cylinders 4.

Figure 1:
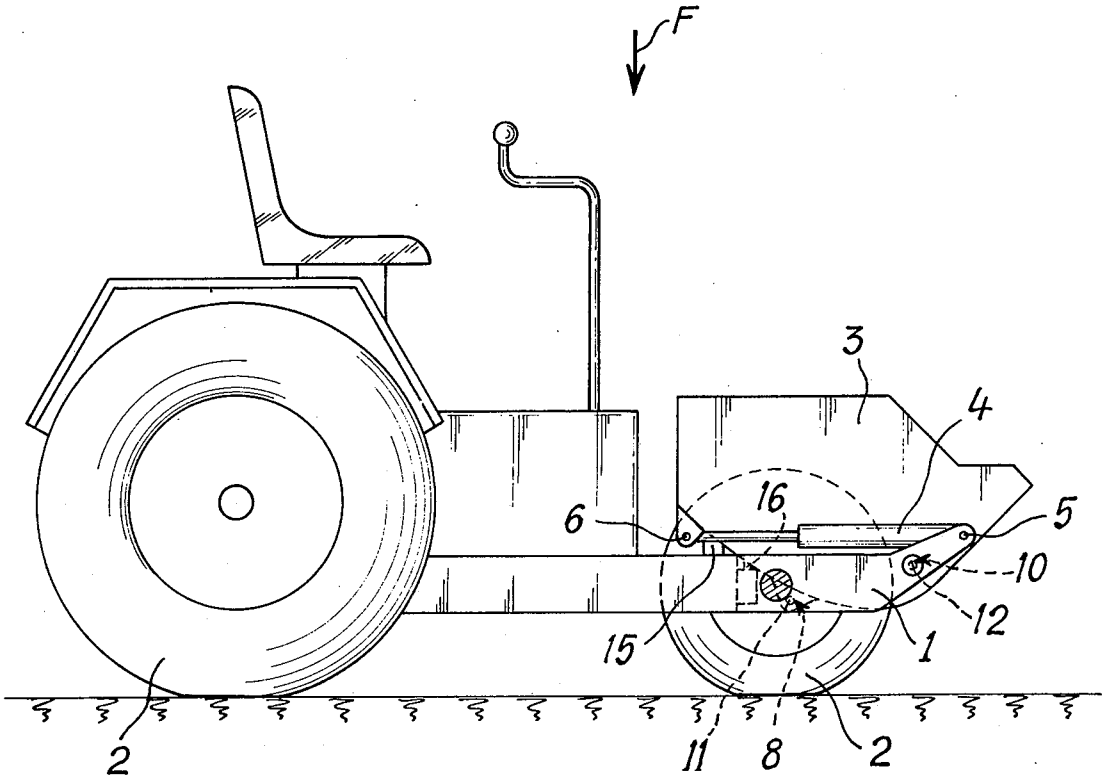
FIG. 1 is a view in elevation of a machine comprising the preferred embodiment according to the invention.
Figure 2:
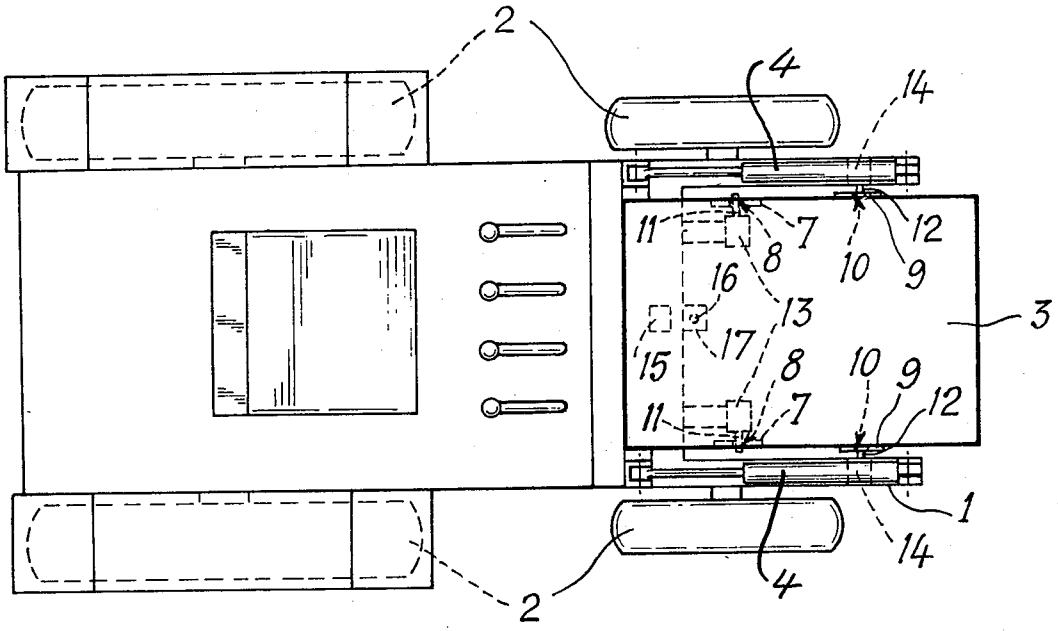
FIG. 2 is a plan view in the direction of arrow F of FIG. 1.

Positioning of the bucket 3 in the generally horizontal position illustrated in FIG. 1 serves to engage the bucket with stop member 15 of the frame with the bucket 3 also engaging the end of rod 16 of distributor 17 to position distributor 17 in the first position of operation in which the conduit 60 is placed in communication with conduit 61 while conduit 62 is closed. Consequently, pressurized fluid in the conduit 60 is directed to the chamber 58 of the jack member 39 so that piston 57 is retracted to compress spring 59 and remove the end 55 of element 56 from contact with the member 53. Consequently, the distributor 37 is then freely operated and can be positioned in either its first, second or third position. When distributor 37 is in its first position, it supplies pressurized hydraulic fluid to the chambers 40 and 41 of jacks 13 for extending the jack members to cause the pins 11 to move into the pin socket openings 8 while pins 12 are kept in a retracted position by virtue of the supply of pressurized hydraulic fluid to the chambers 41.

Positioning of the distributor 37 in its second position causes the pins 11 to be inserted in the pin socket openings 8 by the supply of hydraulic fluid to the chamber 40 while chambers 41 are concurrently connected to exhaust to reservoir 21 so that the springs 43 operate to insert the pins 12 in the pin socket openings 10.

Lastly, positioning of distributor 37 in its third position serves to connect chambers 40 and 41 to exhaust to reservoir 21 so that pins 12 are maintained in the pin socket opening 10 by the force of springs 43 while pins 11 are retracted from their respective pin socket openings 8 by the force of spring members 42 in a manner that will be apparent from inspection of FIG. 5.

Consequently, when the bucket is positioned in engagement with the stop member 15 as shown in FIG. 1, pins 11 are positioned in axial alignment with the pin socket openings 8 and pins 12 are positioned in axial alignment with the pin socket openings 10 with distributor 37 being capable of being moved to any one of three possible positions so as to permit either pins 11 or 12 to be inserted in their respective pin socket openings. Movement of the distributor from its thrid position to its first position serves to change the pivotal support of the bucket from support by means of pins 12 to pins 11. It will be apparent that one or the other of the pairs of pins 11 or 12 will always be inserted in their corresponding pin socket openings so that support for the bucket is always positively provided.

In addition, as soon as the bucket 3 is no longer in abutment on the stop 15, the rod 16 released, and the spring 63 pushes the distributor 17 into its second position. The chamber 58 being placed in communication with the reservoir 21, the spring 59 pushes the piston 57 and the rod 55 until the end 55 is introduced into the notch 54*a* or 54*c* corresponding to the position in which the distributor 37 was previously placed. In this way, as soon as the bucket 3 has pivoted and consequently as soon as one of the pairs of pins 11, 12 is no longer disposed opposite the pin socket openings 8, 10 which correspond thereto, the manoeuver of the distributor 37 is blocked. Consequently, the pivotal support of the bucket from either pins 11 or 12 cannot be disconnected while the bucket is in any position other than that illustraated in FIG. 1.

The blocking procured by the distributor 17, associated with the jack 39, thus procures the desired safety of manoeuvre, since, on the one hand, at least one pair of pins 11, 12 is introduced at any moment in the corresponding pin socket openings and, on the other hand, the change of pins is rendered possible only when the various parts are in the position illustrated in FIG. 1.

Bucket 3 is supported for pivotal movement on the pins 11 when the bucket is being used for a loading or digging operation, it being noted that the forward lower end of the bucket is substantially lower when in this position than when the bucket is support for pivotal movement about pins 12 as in the position of FIG. 4. Alternatively, the bucket is supported on pins 12 when it is desired to unload the bucket, with it being noted that the lower end of the bucket is above the surface of the soil so that material carried in the bucket is easily dumped into a pile 19 as shown in FIG. 4.

Figure 6:
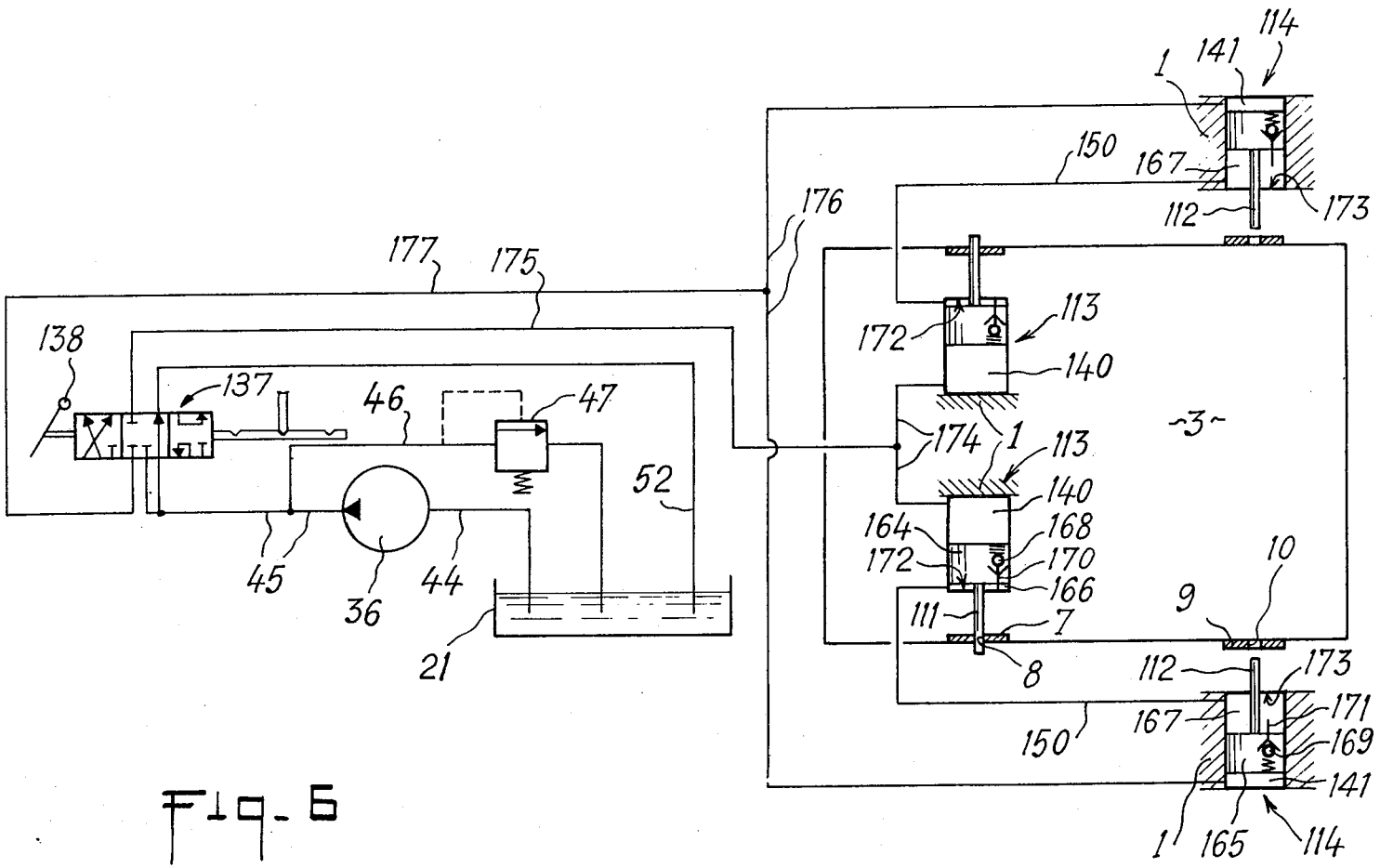
FIG. 6 shows a variant embodiment in accordance

FIG. 6 illustrates an alternative circuit in which double-acting jacks 113 and 114, which are analagous to jacks 12 and 14, are respectively employed for positioning pins 111 and 112 which are analagous to pins 11 and 12 of the first embodiment. Jack 113 has a piston 164 in which an end-of-stroke valve 168 is provided to be opened when the piston reaches the end of the stroke of insertion of the pins in the pin-socket openings as illustrated in FIG. 6. Opening of valve 168 serves to provide communication between the large chambers 140 and small chambers 166 of the double-acting jacks 113.

Similarly, double-acting jack 114 comprises a piston separating a large chamber 141 from a small chamber 167 with an end-of-stroke valve 169 being provided in the pistons for communicating chambers 167 and 141 when the piston moves to the end of the stroke positioning the pin 112 in the pin-socket opening 10. Valves 168 and 169 are respectively actuated by control rods 170 and 171 which engage the end of the cylinders 172 and 173 of the respective jack members.

The small chambers 166 and 167 of the double-acting jacks 113 and 114 on each side of the bucket are placed in communication with each other by conduits 150. The large chambers 140 of the double-acting jacks 113 are placed in communication by a conduit 174 which is connected to a three-way distributor 137 by a conduit 175. The large chambers 141 of the double-acting jacks 114 communicate with each other by means of a conduit 176 which is connected to a conduit 177 extending to the distributor 137. A conduit 45 from pump 36 is also connected to the distributor 137 as is an exhaust line 52.

The provision of pressurized fluid in the large chambers 140 and 141 serves to cause movement of the pins 111 and 112 into the pin-socket openings 8 and 10. Distributor 137 is capable of being positioned in three positions similar to the three positions of previously discussed distributor 37. In a first position, the high-pressure pump output conduit 45 is placed in communication with conduit 175 with conduits 177 and 52 simultaneously being placed in communication with each other so that pressurized fluid from conduit 45 flows into conduit 175, conduit 174 and chambers 140, to cause pistons 164 to insert the pins 111 in the pin-socket openings 8. The foregoing movement of the pistons 164 forces the hydraulic fluid in the small chambers 166 of these chambers into conduits 150 and the small chambers 167 of the double-acting jacks 114 to cause the pistons 165 to retract pins 112 from pin-socket openings 10 with the retracting movement of pistons 165 being permitted by virtue of the fact that the large chambers 141 are in communication with the exhaust conduit 52.

In the second position of the distributor 137, which is illustrated in FIG. 6, conduit 45 is simply connected to exhaust 52 with conduits 175 and 177 being blocked at the distributor valve. Consequently, the pistons of both jacks 113 and 114 are locked in position to prevent movement of the pins 111 and 112 from the positions illustrated in FIG. 6.

In the third position of the distributor 137, the conduit 45 is in communication with conduit 177 so that pressurized hydraulic fluid flows to the large chambers 141 of the double-acting jacks 114 to extend pins 112 into the pin socket openings 10. Simultaneously, conduit 175 is in communication with the exhaust conduit 52 so that the large chambers 140 are also connected to exhaust and the movement of pistons 165 forces hydraulic fluid into the small chambers 166 of the double-acting jacks 113 through conduits 150 so that the pistons 164 are moved to retract pins 111 from the pin socket openings 8. The valves 168 and 169 provided in the pistons of the double-acting jacks serve to maintain the pistons in place and prevent undesired piston movement such as might be caused by a leakage of fluid or the like.

While it should be understood that the subject invention is susceptible of use with a wide variety of devices, one of the prime uses of the invention is in the small loaders for use on construction sites. Numerous modifications of such invention will undoubtedly occur to those skilled in the art, and it should be understood that the spirit and scope of the invention is to be limited solely by the appended claims.

I claim:

1. An earthworking vehicle including a front-to-rear extending frame, a bucket, first selectively activatable pivot means for selectively providing a pivotal connection between said bucket and said frame for permitting said bucket to pivot about a first pivot axis between a generally horizontal load-carrying position on the forward end of said frame and an excavating or loading position in which a forward portion of the bucket is near or below ground level forwardly of the vehicle, second selectively activatable pivot means for selectively providing a second pivotal connection between said bucket and said frame for permitting said bucket to pivot about a second pivot axis between said generally horizontal load-carrying position and an unloading position in which said forward portion of the bucket is in a downward position forwardly of the vehicle but is spaced above ground level to permit the flow of material from the bucket onto the ground surface and bucket tilting power means for pivoting said bucket between said generally horizontal load carrying position and said excavating or loading position when said first selectively activatable pivot means is activated and between said generally horizontal load carrying position and said unloading position when said second selectively activatable pivot means is activated.

2. The invention of claim 1 additionally including synchronization control means for preventing said first and second selectively activatable pivot means from being deactivated to terminate their providing pivotal support of said bucket except when said bucket is in said generally horizontal load-carrying position.

3. The invention of claim 1 wherein said first selectively activatable pivot means comprises a first pair of rearward pivot pin members, said rearward pivot pin members being positioned in coaxial alignment with said first pivot axis on said frame, a rearward pair of pin socket openings in said bucket positioned in alignment with said rearward pivot pins to matingly receive said rearward pivot pin members when said bucket is in said generally horizontal load carrying position, rearward hydraulic jack means connected to said rearward pivot pins for moving said rearward pivot pins into said rearward pin socket openings to provide pivotal support of said bucket on said frame or to a retracted position in which said rearward pivot pins are retracted from rearward pin socket openings and wherein said second selectively activatable pivot means comprises a forward pair of pivot pin members positioned in coaxial alignment with said second pivot axis on said frame, a forward pair of pivot socket openings in said bucket coaxially aligned with said forward pair of pivot pins, forward hydraulic jack means connected to said forward pivot pins for moving said forward pivot pins into mating relationship with said forward pivot socket openings to provide pivotal support of said bucket on said frame by said forward pivot pins or to a retracted position in which said forward positioned pivot pins are retracted from said forward pin socket openings.

4. The invention of claim 3 additionally including synchronization control means for preventing said rearward hydraulic jack means from being activated to move said rearward pivot pin members from said rearward pin socket openings and to prevent said forward hydraulic jack means from being activated to move said forward pin means from said forward pin socket openings except when said bucket means is in said generally horizontal load-carrying position.

5. The invention of claim 4 additionally including distributor valve means for selectively providing pressurized hydraulic fluid to said forward hydraulic jack means and said rearward hydraulic jack means, said distributor valve means having a manually movable valve member for such purpose, said synchronization control means including a latching member activatable to engage and restrain movement of said movable valve member.

6. The invention of claim 1 wherein said first pivot axis is positioned rearwardly of and below said second pivot axis with respect to said front-to-rear extending frame.

7. The invention of claim 6 wherein said first selectively activatable pivot means comprises a first pair of rearward pivot pin members, said rearward pivot pin members being positioned in coaxial alignment with said first pivot axis on said frame, a rearward pair of pin socket openings in said bucket positioned in alignment with said rearward pivot pins to matingly receive said rearward pivot pin members when said bucket is in said generally horizontal load carrying position, rearward hydraulic jack means connected to said rearward pivot pins for moving said rearward pivot pins into said rearward pin socket openings to provide pivotal support of said bucket on said frame or to a retracted position in which said rearward pivot pins are retracted from said rearward pin socket openings and wherein said second selectively activatable pivot means comprises a forward pair of pivot pin members positioned in coaxial alignment with said second pivot axis on said frame, a forward pair of pivot socket openings in said bucket coaxially aligned with said forward pair of pivot pins, forward hydraulic jack means connected to said forward pivot pins for moving said forward pivot pins into mating relationship with said forward pivot socket openings to provide pivotal support of said bucket on said frame by said forward pivot pins or to a retracted position in which said forward positioned pivot pins are retracted from said forward pin socket openings.

8. The invention of claim 7 additionally including synchronization control means for preventing said rearward hydraulic jack means from being actuated to move said rearward pivot pin members from said rearward pin socket openings and to prevent said forward hydraulic jack means from being activated to move said forward pin means from said forward pin socket openings except when said bucket means is in said generally horizontal load-carrying position.

9. The invention of claim 8 wherein said rearward hydraulic jack means includes spring biassing means for urging said rearward pivot pin members from said rearward pin socket openings and wherein said forward hydraulic jack means includes spring biassing means for urging said forward pivot pin members into said forward pin socket openings.

10. The invention of claim 8 wherein said rearward hdyraulic jack means comprises a first jack member position on one side of said bucket and a seconnd rearward jack member positioned on the opposite side of said bucket, said forward hydraulic jack means comprises a first forward hydraulic jack member positioned on one side of said bucket and a second forward hydraulic jack means positioned on the opposite side of said bucket, each of said hydraulic jack members having a small chamber and a large chamber and valve means in the piston of each hydraulic jack for communicating the respective small chambers and large chambers of each jack when the jacks are moved to an extended position for inserting said pivot pins in their respective pin socket openings and conduit means providing communication between the small chamber of the rearward hydraulic jack members and the small chamber of the forward hydraulic jack member on the same side of the bucket and conduit means providing communication between the large chambers of said forward hydraulic jack members and conduit means providing communication between the large chambers of said rearward hydraulic jack members.

* * * * *